United States Patent [19]

McCormack

[11] 3,946,796

[45] Mar. 30, 1976

[54] APPARATUS FOR MAKING SAND-RESIN MOLDS

[75] Inventor: William McCormack, Studley, England

[73] Assignee: British Cast Iron Research Association, Birmingham, England

[22] Filed: June 27, 1974

[21] Appl. No.: 483,769

[30] Foreign Application Priority Data

June 28, 1973 United Kingdom ..... 30942/73

[52] U.S. Cl. ..... 164/200; 164/21

[51] Int. Cl.[2] ..... B22C 15/00

[58] Field of Search ..... 164/19, 20, 21, 22, 43, 164/44, 200, 201, 202; 259/169, 170, 171, 172, 178 A, 43, 44, 4; 425/215, 216, 217; 222/482, 486

[56] References Cited

UNITED STATES PATENTS

| | | | |
|---|---|---|---|
| 2,633,859 | 4/1953 | Klosse | 259/4 |
| 2,852,818 | 9/1958 | Shallenberger et al. | 164/200 |
| 3,166,219 | 1/1965 | Rudd | 222/486 |
| 3,225,396 | 12/1965 | Hansberg | 164/202 |
| 3,489,296 | 1/1970 | Snow | 222/486 |
| 3,572,652 | 3/1971 | Hale | 259/169 |
| 3,704,743 | 12/1972 | Edwards | 164/21 |
| 3,722,832 | 3/1973 | Seifert | 259/44 |
| 3,776,675 | 12/1973 | Veneria | 425/215 |
| 3,822,737 | 7/1974 | Edwards | 164/22 |
| 3,834,442 | 9/1974 | Edwards | 164/200 |

*Primary Examiner*—Francis S. Husar
*Assistant Examiner*—Carl Rowold
*Attorney, Agent, or Firm*—Scrivener Parker Scrivener and Clarke

[57] ABSTRACT

In foundry core-making or mold-making apparatus employing a rotary mixer working in a chamber and mixing together a sand-resin mix and a sand-catalyst mix to produce a cold quick-setting mixture that is then quickly discharged through the bottom of the chamber into a core-blower or molding machine, the chamber is fixed and has two separately movable sliding shutters controlling openings in its floor (it may be one long opening), one shutter controlling discharge into the blower or molding machine and the other controlling discharge of any residue to a waste chute. Preferably the first shutter uncovers a peripheral portion of the floor first, the discharge area thus growing from the periphery in a radial inward direction.

4 Claims, 5 Drawing Figures

APPARATUS FOR MAKING SAND-RESIN MOLDS

This invention relates to the manufacture of foundry cores, although it may be extended to the production of foundry moulds as well. It has been proposed to form cores by taking two bodies of sand, one containing resin and the other containing a catalyst and, after mixing the two bodies together, rapidly blowing them into a core box. It is important that the mixing and blowing should take place in quick succession so that the mixture does not set while still within the mixing chamber. In British patent specification No. 1 133 255 there is described a particularly rapid method where the mixing is itself done by blowing, and a further development is described in British patent specification No. 1 225 036.

It has also been proposed to do the mixing mechanically by the use of a paddle rotating about a vertical axis. Because of the difficulties that would be caused if any of the mixture were to be left in the mixer to set between cycles, it has been found necessary in that apparatus for the entire mixer to be shifted laterally, after each blowing cycle, to a station at which it can be purged by a blast of air.

The aim of the present invention is to allow complete and effective purging of the mixing chamber without the need for moving the chamber bodily. A further aim is to provide means for discharging the material in a way so that the part of the material which has been most thoroughly mixed is discharged first and any unmixed or inadequately mixed material is left until last or is left in the chamber. According to the invention there is proposed mixing apparatus for foundry sand mixtures comprising a stationary mixing chamber equipped with a rotary mechanical mixer and having in its floor at least one discharge opening, the opening or openings being controlled by two separate shutters each capable of separate movement to control its associated opening or its associated portion of the single opening, a first one of the shutters controlling discharge of the contents of the chamber into a foundry core-making or mould making machine and the second controlling discharge of the contents of the chamber to a waste chute.

In a preferred arrangement the shutters are horizontally moving power-actuated sliding shutters, and they move along a common line, diametrically across the circular base of the mixing chamber. The base is completely open apart from two relatively narrow segment-shaped portions on opposite sides of the path of the shutters, that is to say, the width of the shutters and of the combined single opening that they close off is at least half the diameter of the base.

The invention will now be further described by way of example with reference to the accompanying drawings, in which.

Figure 1:
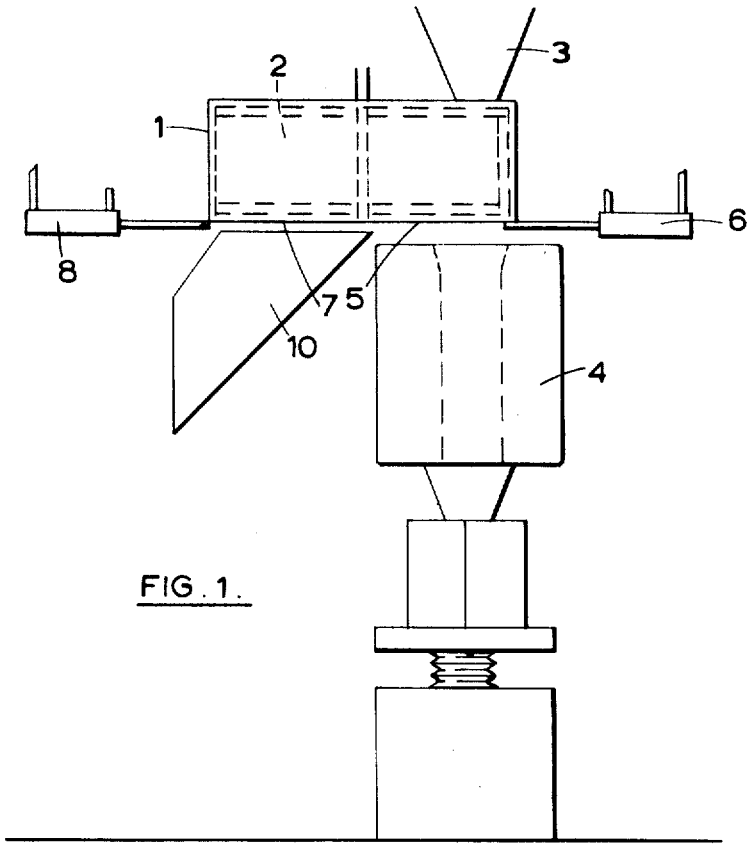
FIG. 1 is a general diagrammatic view of apparatus according to the invention.
Figure 2:
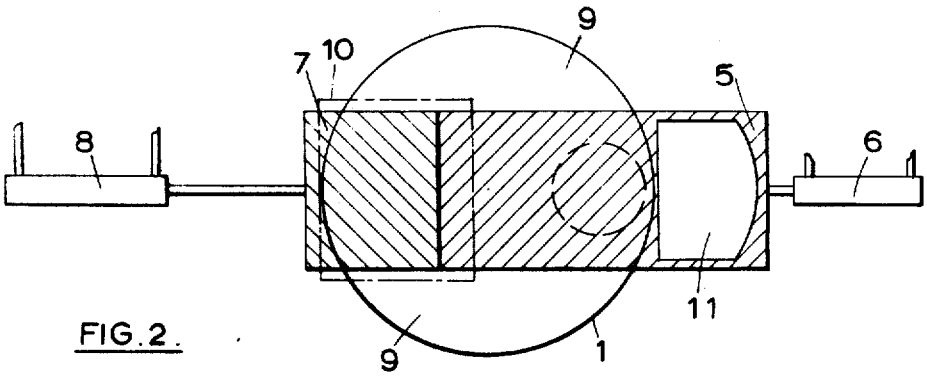
FIG. 2 is a horizontal section through the lower part of the mixing chamber.

Referring first to FIGS. 1 and 2 the apparatus illustrated comprises a cylindrical drum-like mixing chamber 1 with its axis vertical and containing a rotary paddle mixer 2 rotating about the axis of the chamber and having blades which extend virtually to the outer wall of the chamber. An inlet chute 3 receives measured quantities of two bodies of foundry sand, one containing resin and the other containing catalyst, from measuring chambers, not shown, in accordance with a known principle for forming foundry cores. By this principle, the two bodies of sand are mixed together and, because the resin and catalyst will immediately start reacting together and cause the resin to set the sand into a solid body, the mixture must be passed into the core blower shown at 4, as rapidly as possible; in the core blower the mixture sets in core boxes to form foundry cores, which are then ejected. The process is convenient, in that the setting is quick, and is done cold, so there is no question of heating the core boxes, but its success is dependent on the mixing being rapid and on the mixing chamber being completely cleared of sand mixture at each cycle of operation as any residues which are left will set hard and interfere with the next cycle.

To control the discharge of the sand mixture into the core blower 4 we provide in the floor of the mixing chamber 1 a flat horizontally sliding shutter 5 actuated by a pneumatic cylinder 6. This shutter 5 occupies at least half the width of the floor of the chamber, and in length it extends more than half way across in its closed position.

Abutting one end of the shutter 5 is a second shutter 7 of the same width, actuated by a pneumatic cylinder 8. The two shutters together extend across the full diameter of the floor of the chamber 1 and so the opening in the floor that receives them thus leaves only two relatively narrow segment-shaped portions of floor 9 present. In fact, in a modification, it would be possible for the floor to be formed wholly by the two shutters.

The part of the opening controlled by the second shutter 7 lies over a waste chute 10. The first shutter 5, in its closed position, shown in FIG. 2, extends beyond the cylindrical wall of the chamber 1 and has in this extended portion an aperture 11. To discharge the contents of the mixing chamber into the core blower 4 the shutter has to be advanced (to the left as viewed in FIGS. 1 and 2) to bring this opening over the inlet of the core blower; in advancing to the left, the shutter 5 pushes the shutter 7 also to the left.

Figure 3:
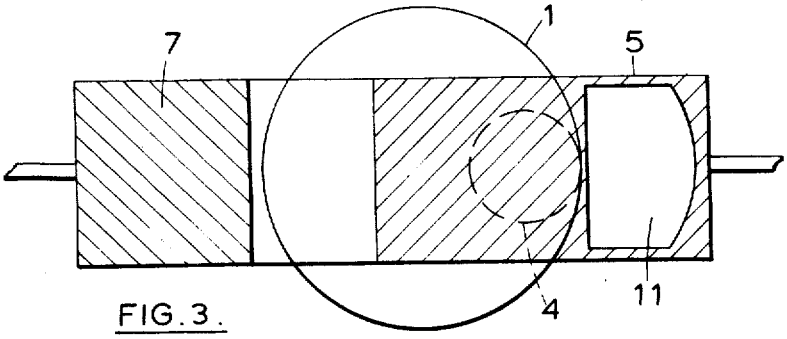
FIGS. 3, 4 and 5 are views similar to FIG. 2 and show three successive positions taken up by the shutters.

FIG. 3 shows the positions of the shutters at the start of a cycle. The first shutter 5 is closed and the second shutter 7 is open, i.e. retracted to the left, allowing any sand mixture left over from the previous cycle to pass to the waste chute 10.

Figure 4:
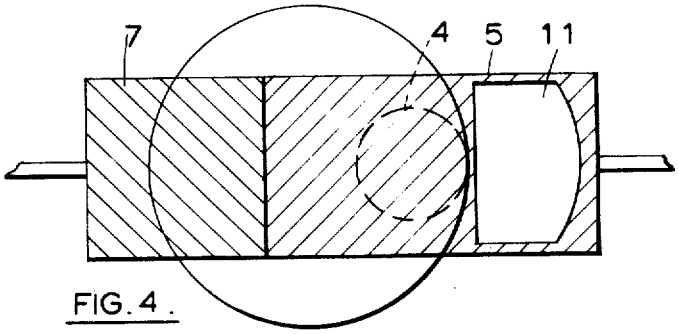

To start the cycle the shutter 7 is closed. A limit switch (not shown) that responds to this shutter reaching its fully closed position, shown in FIG. 4 and dependent also on the other shutter being closed, initiates, or at least allows, the feeding of the appropriate charges of sand-resin mixture and sand-catalyst mixture from the inlet chute 3. After the rotary paddle mixer 2 has mixed the two charges together for a predetermined time, of the order of a few seconds, the cylinder 6 is actuated to shift the shutter 5 to the left, bringing the aperture 11 within the periphery of the floor of the chamber 1, and allowing the contents of the chamber to pass into the core blower 4, where they are immediately blown into core boxes in a conventional manner.

It is an important feature of the apparatus described that the shutter moves in such a direction as to start uncovering the aperture 11 from the periphery of the chamber 1 inwards, rather than from the centre outwards. Because of the greater velocity of the paddle blades at the periphery as compared with the centre, the mixing will have reached an adequate extent first at the periphery, and so one can start discharging the material from the region of the periphery of the chamber even while the mixing in regions nearer the centre is still incomplete. Also this arrangement ensures that the very small amount of unmixed material which may remain in the mixer chamber will be discharged last and will not, therefore, enter the critical parts of the core box which would result in an imperfect core.

Figure 5:
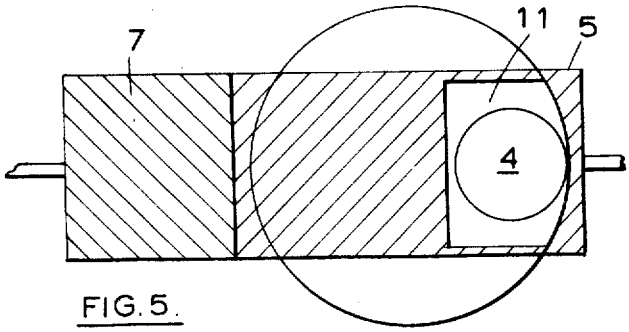

On completion of the opening movement the shutters occupy the positions shown in FIG. 5, with the leading edge of the shutter 5 having pushed the shutter 7 clear of the left-hand side of the chamber 1. When sufficient of the contents of the chamber 1 have been discharged into the core blower 4, the shutter 5 is retracted by the cylinder 6 to the position shown in FIG. 3 while the paddles 2 continue to revolve, and any residue of sand-resin-catalyst mixture still left in the chamber 1 passes down the waste chute 10, leaving the apparatus ready for the start of another cycle.

This purging action, i.e. the clearance of residual mixture from the chamber, may be assisted by vibration of the blades or of the chamber, or by a blast of air. There may be a shutter (not shown) that closes off the inlet to the chamber 1 from the chute 3 during the application of such an air blast.

It will be understood that the cylinders 6 and 8 lend themselves to the application of automatic control, and the whole cycle can be automatic, with the operations of the cylinders and the feeding of the materials interlinked by limit switches and timers. Hydraulic cylinders or even mechanical drives may be used in place of the pneumatic cylinders.

The arrangement shown, in which the two shutters meet near the axis of the chamber and in which the shutter 5, in advancing, pushes the other shutter 7 back, radially away from the axis, has the advantage that the cylinder 8 need only be single acting. In an alternative, though less satisfactory, arrangement, the shutters could be allowed to overlap.

Also, instead of a single opening stretching the full width of the chamber and controlled by the two shutters, one could have two separate openings, although again this would be less satisfactory in that it would increase the scope for residues of hard sand mixture to lodge in the chamber and fail to be discharged.

I claim:

1. Mixing apparatus for foundry sand mixtures, said apparatus comprising a stationary mixing chamber having in its floor an opening extending across the full width of the floor, a rotary mechanical mixer within said chamber, first and second separate shutters each capable of separate movement horizontally across the opening from opposite sides and adapted to come into mutual contact to close the opening, said shutters controlling associated opening portions, a foundry core-making or mould-making machine having an inlet placed to receive material from the opening portion covered by said first shutter and a waste chute having an inlet placed to receive material from the opening portion covered by said second shutter.

2. The mixing apparatus of claim 1 wherein said shutters meet, to close the opening, near the middle of the floor of said chamber, said second shutter being retractable horizontally away from this position radially outwards with respect to the axis of said chamber to uncover its associated portion of said opening.

3. The mixing apparatus of claim 2 wherein said first shutter has in it an aperture which, in the closed position of said shutters, lies outside the periphery of said chamber, and in which said first shutter uncovers its associated portion of the opening by advancing to bring said aperture within the periphery of said chamber, thereby uncovering a peripheral portion of said opening first.

4. The mixing apparatus of claim 3 wherein said first shutter is adapted to engage and push back said second shutter, whilst itself maintaining closed that portion of the opening which is associated with said second shutter.

* * * * *